US010556257B2

(12) United States Patent
Anderson

(10) Patent No.: US 10,556,257 B2
(45) Date of Patent: Feb. 11, 2020

(54) HOSE CLEARING APPARATUS

(71) Applicant: Berkley Wyatt Anderson, Washington, UT (US)

(72) Inventor: Berkley Wyatt Anderson, Washington, UT (US)

( * ) Notice: Subject to any disclaimer, the term of this patent is extended or adjusted under 35 U.S.C. 154(b) by 4 days.

(21) Appl. No.: 15/927,928

(22) Filed: Mar. 21, 2018

(65) Prior Publication Data

US 2018/0272393 A1 Sep. 27, 2018

Related U.S. Application Data

(60) Provisional application No. 62/474,480, filed on Mar. 21, 2017.

(51) Int. Cl.

| | |
|---|---|
| ***E03B 7/12*** | (2006.01) |
| ***B08B 9/032*** | (2006.01) |
| ***E03B 7/10*** | (2006.01) |

(52) U.S. Cl.

CPC ..... *B08B 9/032* (2013.01); *E03B 7/10* (2013.01); *B08B 2209/032* (2013.01)

(58) Field of Classification Search

None

See application file for complete search history.

(56) References Cited

U.S. PATENT DOCUMENTS

| | | | | |
|---|---|---|---|---|
| 3,845,779 A * | 11/1974 | Greene, Jr. | ..... | A62C 33/00 137/209 |
| 4,269,147 A * | 5/1981 | Vorbeck | ..... | A01K 7/02 119/73 |
| 7,198,057 B2 * | 4/2007 | Zhurin | ..... | E03B 7/12 137/240 |
| 2011/0079654 A1 * | 4/2011 | Bailey | ..... | A01G 25/16 239/1 |

* cited by examiner

*Primary Examiner* — Mikhail Kornakov
*Assistant Examiner* — Ryan L. Coleman
(74) *Attorney, Agent, or Firm* — Gurr Brande & Spendlove, PLLC; Robert A. Gurr

(57) ABSTRACT

A hose/conduit clearing apparatus has an electric blower, a check valve, and a faucet coupler; the faucet coupler having a first end for threading to a faucet, a second end for threading to a conduit, and a blower connecting port wherein the blower is coupled to the blower connecting port via the check valve. The electric blower is preferably powered by one or more batteries and is activated automatically when reaching a predetermined temperature (e.g., 34 degrees Fahrenheit) or by a user toggling a switch.

4 Claims, 9 Drawing Sheets

HOSE CLEARING APPARATUS

CROSS-REFERENCE TO RELATED APPLICATIONS

This application claims the benefit of U.S. Provisional Application Ser. No. 62/474,480 filed on Mar. 21, 2017, which is incorporated herein by reference.

TECHNICAL FIELD

The present disclosure relates to clearing liquids from hoses and pipes. More particularly, the present disclosure relates to an apparatus for clearing the liquid from the hose or pipe to prevent freezing.

BACKGROUND

Many areas in the world have temperatures that fall to below freezing (32 degrees Fahrenheit). In these areas, it may be difficult to keep conduits, such as hoses and pipes, from freezing due to liquids that remain in the conduit (also referred to herein as the "residue"). For example, a rancher may use a hose to supply his livestock with drinking water. Once the reservoir is full and the rancher turns off the spigot (also referred to as a "faucet"), the hose will likely still have water (residue) inside. This may be due to inclines over which the hose passes, surface tension between the water and the hose, or any number of other factors. If the temperature is either currently freezing or will drop to freezing overnight, the hose may become solidified. When this occurs, the rancher will not be able to supply water to the livestock. Further, in some cases, the expansion of the ice may compromise the hose and/or the spigot. This is an important issue, especially if the spigot is attached to a house/trailer. For example, a garden hose left connected to a home can freeze and create liabilities to the home. Other areas include the use of RVs or other vehicles that may have a water supply that uses a conduit. Further, as mentioned above, hoses alone aren't susceptible to freezing, but pipes and other conduits (e.g., sprinkler systems) may also be subjected to freezing temperatures. In such a scenario, it is important to remove the residue from the conduit before freezing.

One method for ensuring a hose is empty is to disconnect and wind the hose. However, this takes additional time, is cumbersome, and the user must outstretch the hose with each use. Further, if using a pipe or other rigid or semi-rigid conduit, winding is not possible. As such, there is a need to extract liquid from the conduit when not in use that does not require disassembly or winding of the conduit. The present disclosure seeks to solve these and other problems.

SUMMARY OF EXAMPLE EMBODIMENTS

In one embodiment, a conduit clearing apparatus comprises an electric blower, a check valve, and a faucet coupler; the faucet coupler having a first end for threading to a faucet, a second end for threading to a conduit, and a blower connecting port wherein the blower is coupled to the blower connecting port via the check valve. The electric blower is preferably powered by one or more batteries and is activated by a user toggling a switch.

In one embodiment, the conduit clearing apparatus comprises a timer that correlates to the length of conduit being cleared, the timer functioning as the blower power switch.

In one embodiment, the conduit clearing apparatus comprises a thermal control circuit. The thermal control circuit may comprise a temperature sensor chip (e.g., LM35) and a relay. When the temperature falls below a predetermined level (e.g., 34 degrees Fahrenheit), the temperature sensor chip actuates the relay, the relay activating the blower for a predetermined time. The circuit may comprise components known in the art, such as Zener diodes, resistors, and the like to achieve optimal functionality.

In one embodiment, the conduit clearing apparatus comprises a temperature sensor and a microcontroller, wherein the microcontroller is preprogrammed with logic to activate the blower for the user specified time (correlated to hose length or other factors, such as pressure) upon reaching a predetermined temperature (e.g., 34 degrees Fahrenheit).

DETAILED DESCRIPTION OF EXAMPLE EMBODIMENTS

Figure 1:
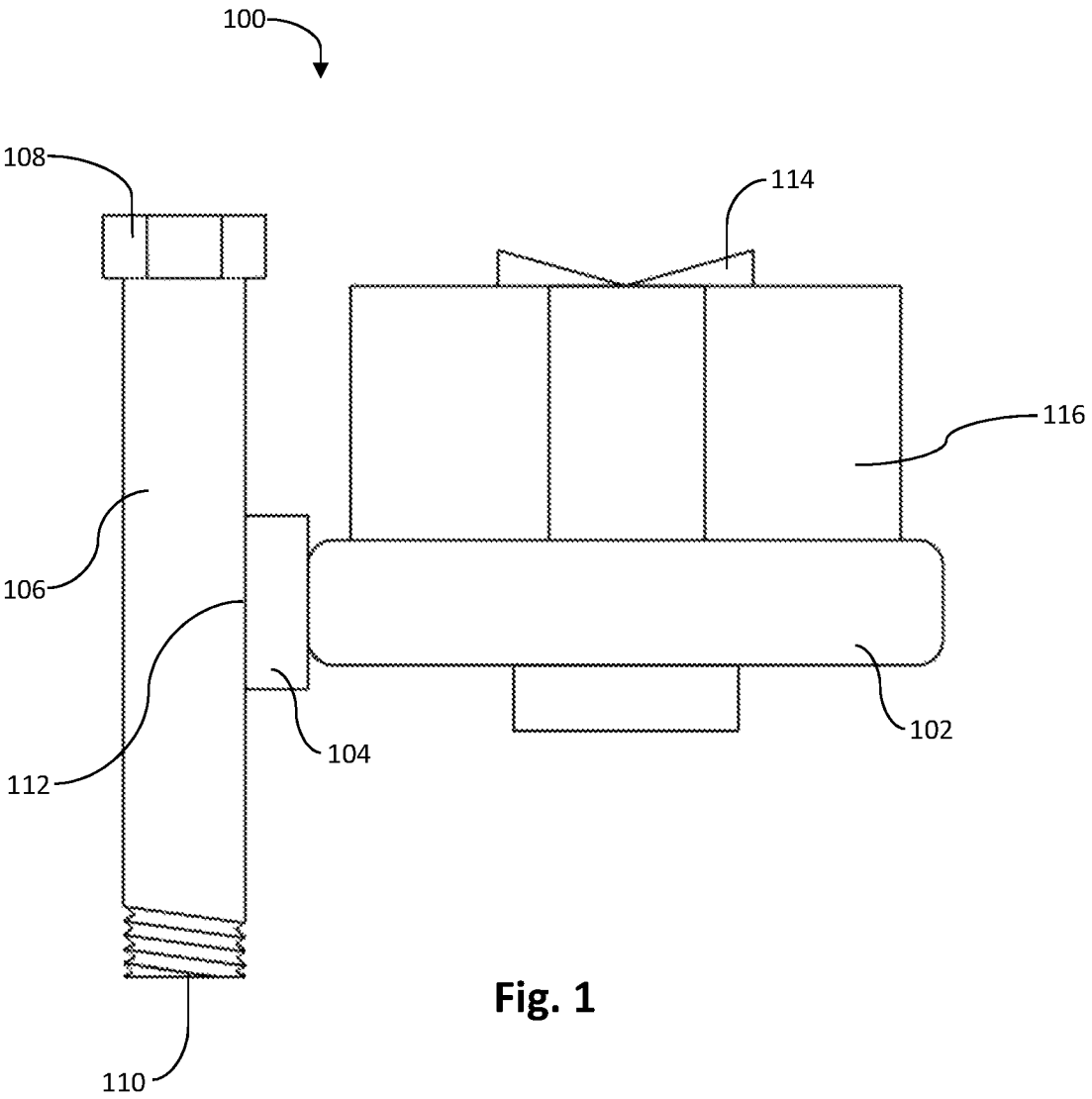
FIG. 1 illustrates a side elevation view of a hose clearing apparatus.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for an apparatus that can clear a conduit when not in use so as to avoid freezing within the conduit. The hose clearing apparatus described herein solves these needs and others. While the examples herein often refer to a hose, it will be appreciated that any conduit, such as a pipe, is also contemplated herein.

In one embodiment, as shown in FIG. 1, a hose clearing apparatus 100 comprises an electric blower 102, a check valve 104, and a faucet coupler 106. The faucet coupler 106 has a first end 108 for threading to a faucet, a second end 110 for threading to a conduit (e.g., hose, pipe, or equivalent), and a blower connecting port 112 wherein the blower 102 is coupled to the blower connecting port 112 via the check valve 104. The electric blower 102 is preferably powered by one or more batteries and is activated by a user toggling a switch 114. For example, a user would open the faucet valve, wherein water would then pass through the faucet coupler 106 and through the conduit. When the desired water is achieved, the user would then close the faucet valve. A user could then toggle the switch 114, activating the blower 102, wherein the air would pass through the check valve 104 and be forced into the faucet coupler 106 and conduit, thereby clearing the residue within the conduit. The user would then toggle the switch 114 to deactivate the blower 102. With the blower 102 off, the check valve 104 will once again close, prohibiting water from entering the blower 102. The blower 102 may be battery powered, with the batteries being stored in a housing 116 or separate therefrom (e.g., in a housing that is connectable to the blower 102 via a cable, which allows for easy transportation for charging). The batteries may be of any variety (standard C or D batteries, Lithium Ion, etc.), including rechargeable.

Figure 2:
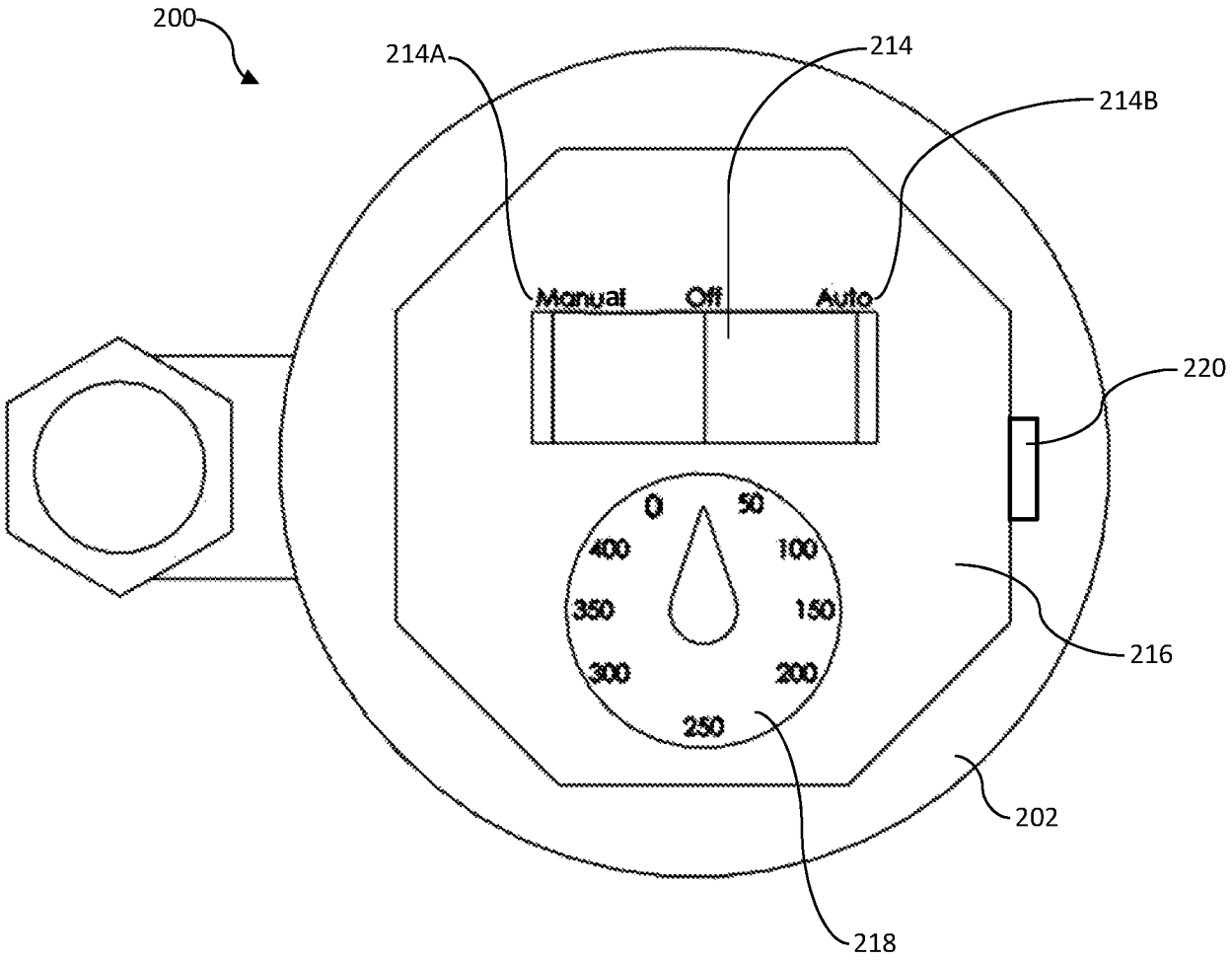
FIG. 2 illustrates a top plan view of a hose clearing apparatus.
Figure 3:
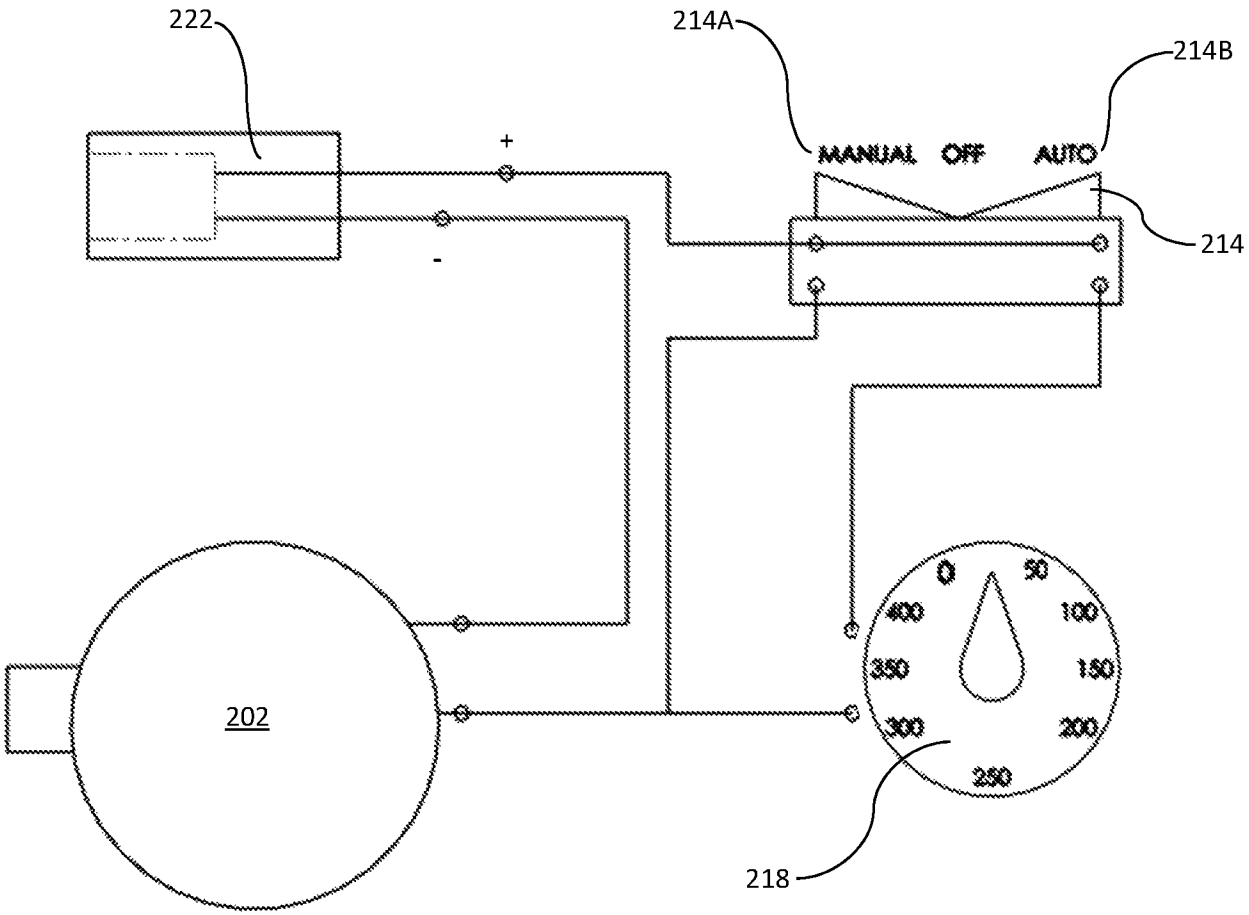
FIG. 3 illustrates a wiring diagram of a hose clearing apparatus.

In one embodiment, as shown in FIG. 2, the conduit clearing apparatus 200 comprises a timer switch 218 that correlates to the length of conduit being cleared, the timer switch 218 functioning as the blower 202 power switch. For example, if the timer switch 218 is set to 50 feet, the blower may be activated for one minute. A 100-foot hose may require two minutes of blower time, etc. This time may be set by the manufacturer, or may be adjusted by a user during a setup configuration. A control switch 214 determines whether the timer switch 218 is activated. In other words, if the control switch 214 is Off, the blower 202 cannot be activated. If the control switch 214 is toggled to a first position 214A (the "Manual" position), the blower 202 is activated and will remain activated until the control switch 214 is toggled again by a user. In an alternate embodiment, the Manual position 214A is spring-activated. In other words, a user depresses the control switch 214 to the Manual position 214A to activate the blower 202. However, once a user releases the control switch 214, the control switch returns to the Off position. This keeps the keeps the batteries from draining unintentionally. If the control switch 214 is toggled to a second position 214B (the "Auto" position), the blower 202 is only activated when the timer switch 218 is actuated. Once the timer ends, the circuit opens and the blower 202 is deactivated. The timer switch 218 preferably correlates to the length of the conduit. For example, a user would toggle the control switch 214 to the Auto position 214B, and then would actuate the timer switch 218 to the appropriate conduit length (e.g., 100 ft.). The blower 202 would then blow for a predetermined time, calculated to clear a conduit of that length, ensuring the conduit is clear before ceasing. An example wiring diagram is shown in FIG. 3. It will be appreciated that while a control switch 214 is used in this example, the control switch 214 is not required. In other words, the timer switch 218 could be the sole switch for activating the blower 202 without need for the manual override that the control switch 214 provides. In other words, a user could manually operate the blower 202 by merely turning the timer switch 218 to the appropriate length, wherein the blower 202 is activated. As the timer switch 218 counts down, it automatically turns off the blower 202 when reaching zero. It will further be appreciated that the batteries that power the conduit clearing apparatus 200 may be removable or non-removable. In either scenario, a charging port 220 may be used so that a user may charge the one or more batteries contained in housing 216.

Referring to the wiring diagram in FIG. 3, the blower 202 is electrically coupled to the timer switch 218, the control switch 214, and a battery connector 222. As understood, if the control switch 214 is toggled to the Manual position 214A, the circuit between the battery connector 222 and the blower 202 is closed, activating the blower 202. In the Off position, the circuit is open. In the Auto position 214B, the circuit between the battery connector 222 and the blower 202 is dependent upon the state of the timer switch 218.

Figure 4:
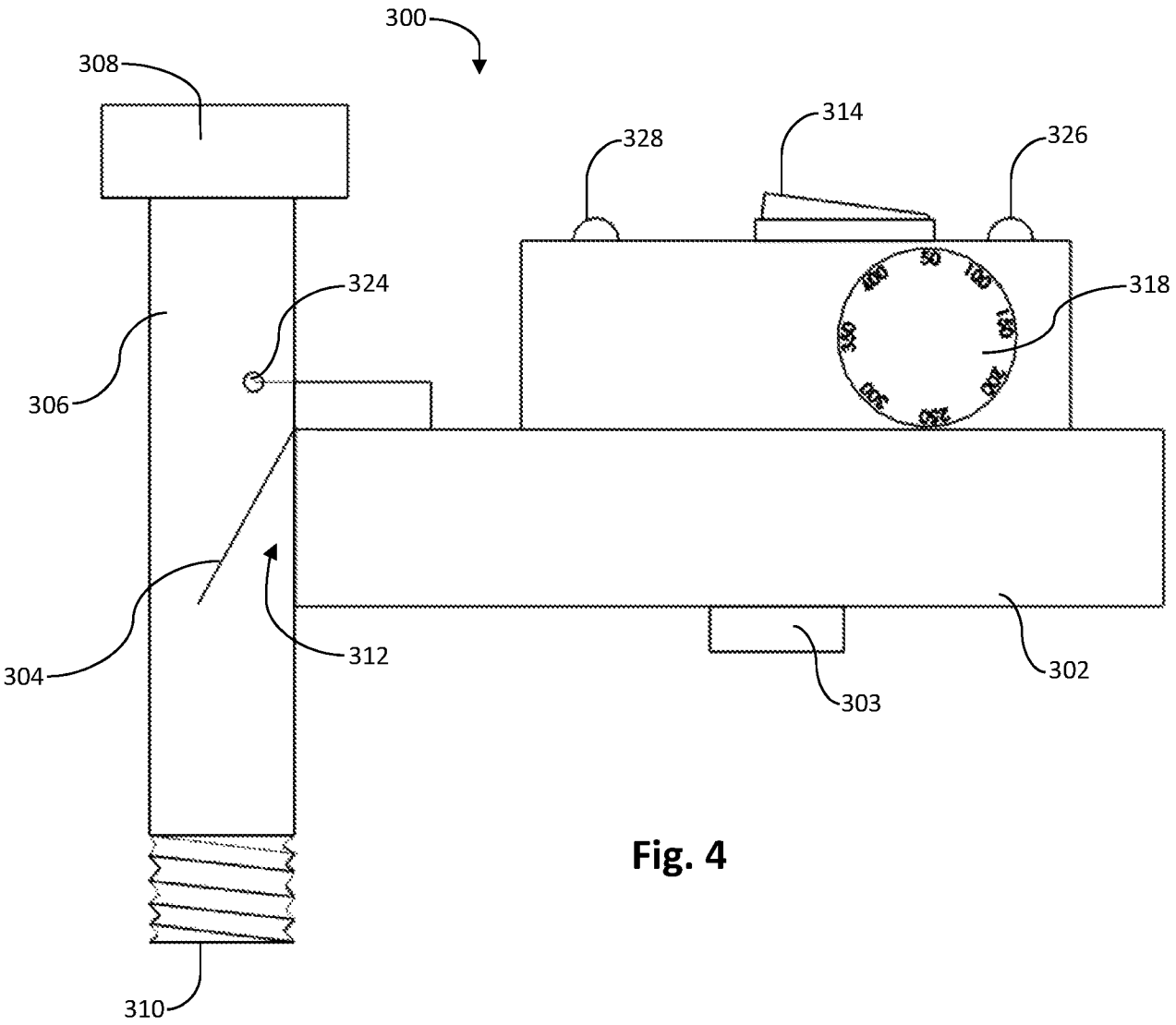
FIG. 4 illustrates a side elevation view of a hose clearing apparatus.

In one embodiment, as shown in FIG. 4, a hose clearing apparatus 300 comprises a blower 302, a check valve 304, a faucet coupler 306 with a first end 308 for coupling to a faucet 310. The check valve 304 controlling the flow of air from the blower 302 through a port 312 to the faucet coupler 306. The blower 302 may be controlled via a variety of means, such as a control switch 314, a timer switch 318, a flow switch 324, or a thermal switch 326. For example, the blower 302 may be manually activated by a user via control switch 314 (e.g., switching it to "Manual"). The user may also place the control switch 314 on "Manual-Timer" which allows the user to rotate the timer switch 318 to the appropriate time via hose length (or other determination), which shuts off the blower 202 when the timer switch 318 concludes. The control switch 314 may be further toggled to "Automatic-Flow" which controls the blower 202 using both the flow switch 324 and the timer switch 318. For example, the flow switch 324 may comprise a water sensor for determining when water has passed through the faucet coupler 306. The switch is activated when water is detected, with the blower 302 activating upon termination of the water passing through the faucet conduit 306, as measured by the water sensor of flow switch 324. As appreciated from the Fig. water enters from the first end 308, passes by and activates flow switch 324, closes the check valve 304 with downward pressure, and exits into the conduit (e.g., hose or pipe) at the second end 310. Once the water ceases, as sensed by the flow switch 324, the blower 302 is activated for a predetermined time, as set by a user using the timer switch 318. As air enters air intake 303, it passes through the port 312 and forces the check valve 304 open so that air can be forced through the second end 310 and out through the conduit, removing any residue in the conduit. It will be appreciated that a microcontroller or similar device may be used to receive signals from the one or more switches and to control the blower 302.

Continuing with FIG. 4, in a further embodiment, a temperature sensor may also be utilized. For example, thermal switch 326 may comprise a temperature sensor and an indicator light (e.g., LED). The thermal switch 326 may be used in connection with the flow switch 324 to ensure that the blower 302 is only activated when temperatures are approaching freezing. For example, the blower 302 is only activated when several conditions are met: 1) the control switch is set to "Automatic-Temp."; 2) water is detected via the flow switch 324; and 3) the temperature is at, or below, a predetermined threshold (e.g., 34 degrees Fahrenheit). As appreciated, a microcontroller may receive signals from the one or more switches, process the signals, and activate the blower 302 accordingly. Additional indicators may also be present, such as a battery indicator 328.

Figure 5:
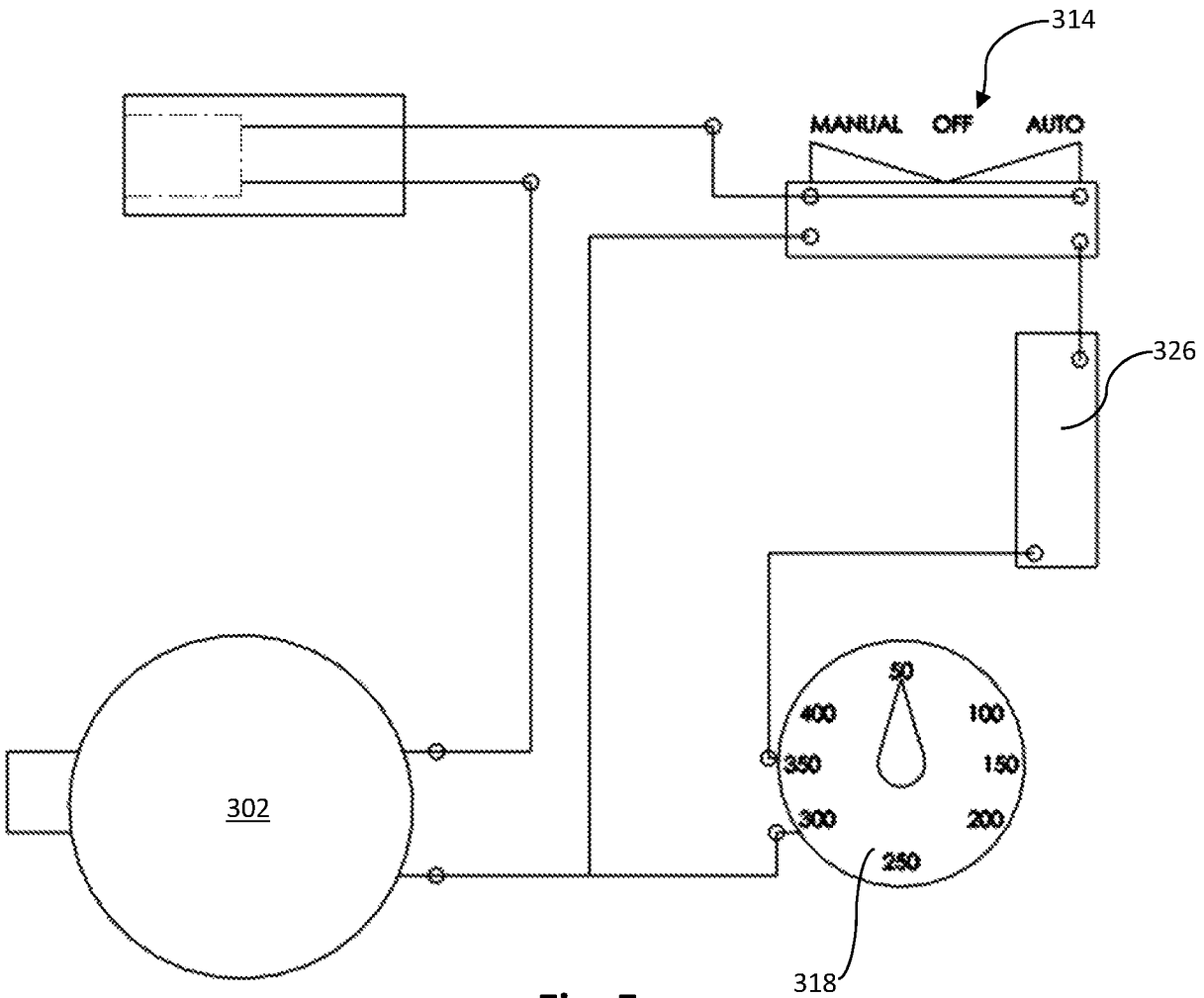
FIG. 5 illustrates a wiring diagram of a hose clearing apparatus.
Figure 6:
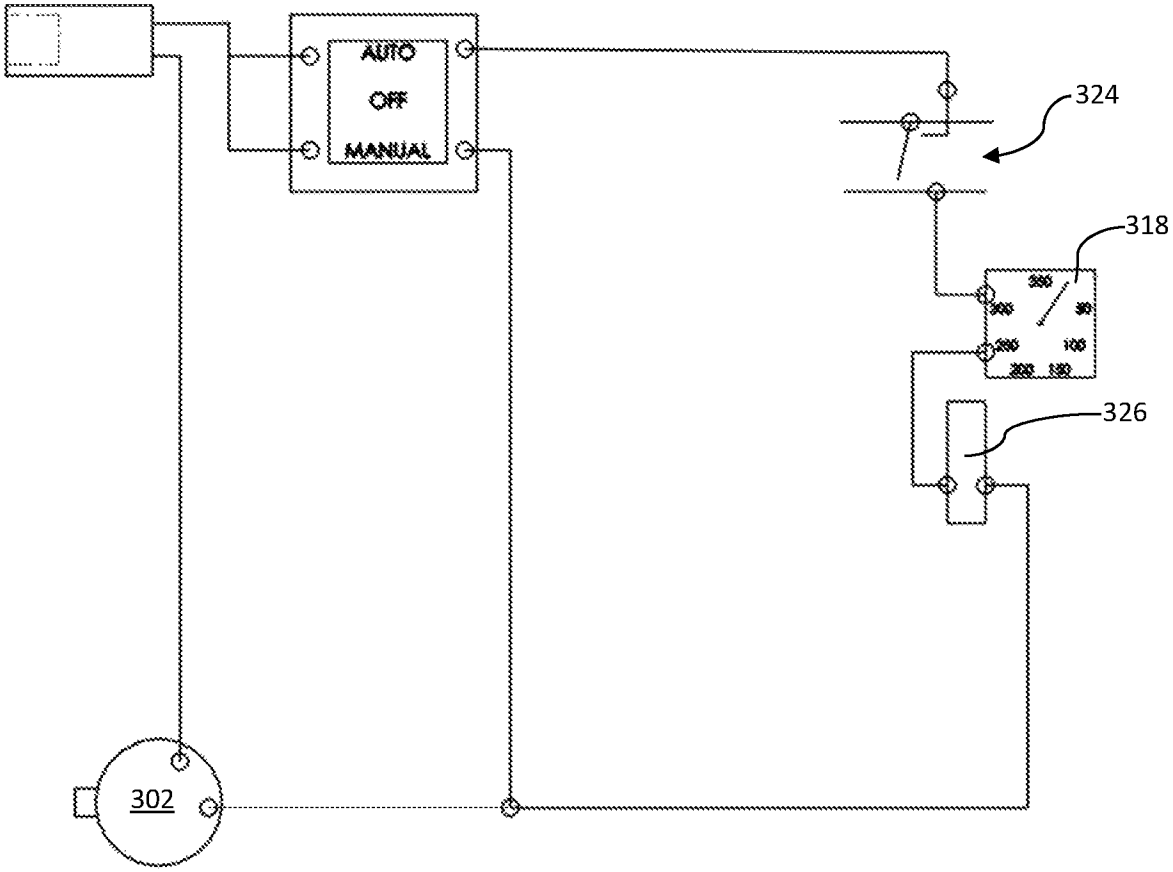
FIG. 6 illustrates a wiring diagram of a hose clearing apparatus.

While a microcontroller may be used, simple switching mechanisms may also be utilized. Example wiring diagrams are shown in FIGS. 5 and 6. As shown in FIG. 5, the thermal control circuit of the thermal switch 326 may comprise a temperature sensor chip (e.g., LM35) and a relay. When the temperature falls below a predetermined threshold (e.g., 34 degrees Fahrenheit), the sensor chip actuates the relay, the relay activating the blower 302 for a predetermined time according to the timer switch 318. In a simple example, the user would toggle the control switch 314 to Auto and would set the timer switch 318 to the corresponding length of hose. The thermal control circuit as part of thermal switch 326 would be located between the control switch 314 and the timer switch 318. If the temperature falls below the predetermined threshold, the circuit closes, which activates the pre-set timer switch 318. Once the timer switch 318 completes, the circuit is opened and the blower 302 deactivates. In one example, the timer switch 318 must again be reset the following day by the user after using the hose in order for the blower 302 to be temperature activated again. However, in another example, the timer switch 318 remains at the predetermined time for repeated use. The thermal circuit may comprise components known in the art, such as Zener diodes, resistors, and the like to achieve optimal functionality. As shown in FIG. 6, a flow switch 324 may be incorporated into the wiring diagram. Accordingly, once the switch is closed (e.g., water pressure upon resistors, etc.), the circuit closes. If the timer switch 318 and thermal switch 326 are likewise closed, the blower 302 is activated. It will be appreciated that the timer switch 318 may be placed either before or after the temperature sensor, as shown in FIGS. 5 and 6.

As used throughout this disclosure, the term blower refers to any air-generating device that is, preferably, electrically powered. The blower may be of a variety of types, including motor-driven rotary fans, squirrel cage fans, impellers, etc.

In one embodiment, as described earlier, the conduit clearing apparatus comprises a temperature sensor and a microcontroller, wherein the microcontroller is preprogrammed with logic to activate the blower for the user specified time (correlated to hose length or other factors) upon reaching a predetermined temperature (e.g., 34 degrees Fahrenheit). For example, a user may simply toggle the control switch to Auto. Using a temperature sensor and preprogrammed logic, the microcontroller can activate the blower for a specified time. The time may either be input by a user by using an interface and user input buttons, or may simply be configured by the manufacturer for specific lengths (e.g., 100 feet). Additional logic or sensors may also be used to prevent the microcontroller from reactivating the blower after the conduit has already been cleared and the conduit has not been subsequently reused. For example, the check valve may have a spring that prohibits it from fully closing without outside pressure. The check valve could have a contact that closes a circuit when fully closed (i.e., when the faucet is opened and water pushes the check valve closed, the contacts would close the circuit, resetting the microcontroller). In another example, a water detector may be used (which are well known in the art) to reset the microcontroller. Having a microcontroller-controlled conduit clearing device would fully-automate the hose clearing process, with the only remaining step for the user being to ensure the batteries are charged. While a timer system may be used for the length of time a blower is activated, another embodiment uses a pressure sensor. For example, when the blower is activated, a back-pressure is created when the air reaches the water. A level of back pressure continues to exist until the conduit is empty and the air may freely flow therefrom. Therefore, in one embodiment, the blower is controlled using, in combination with other sensors described herein (e.g., temperature), a pressure sensor to determine when the conduit is empty.

Figure 7:
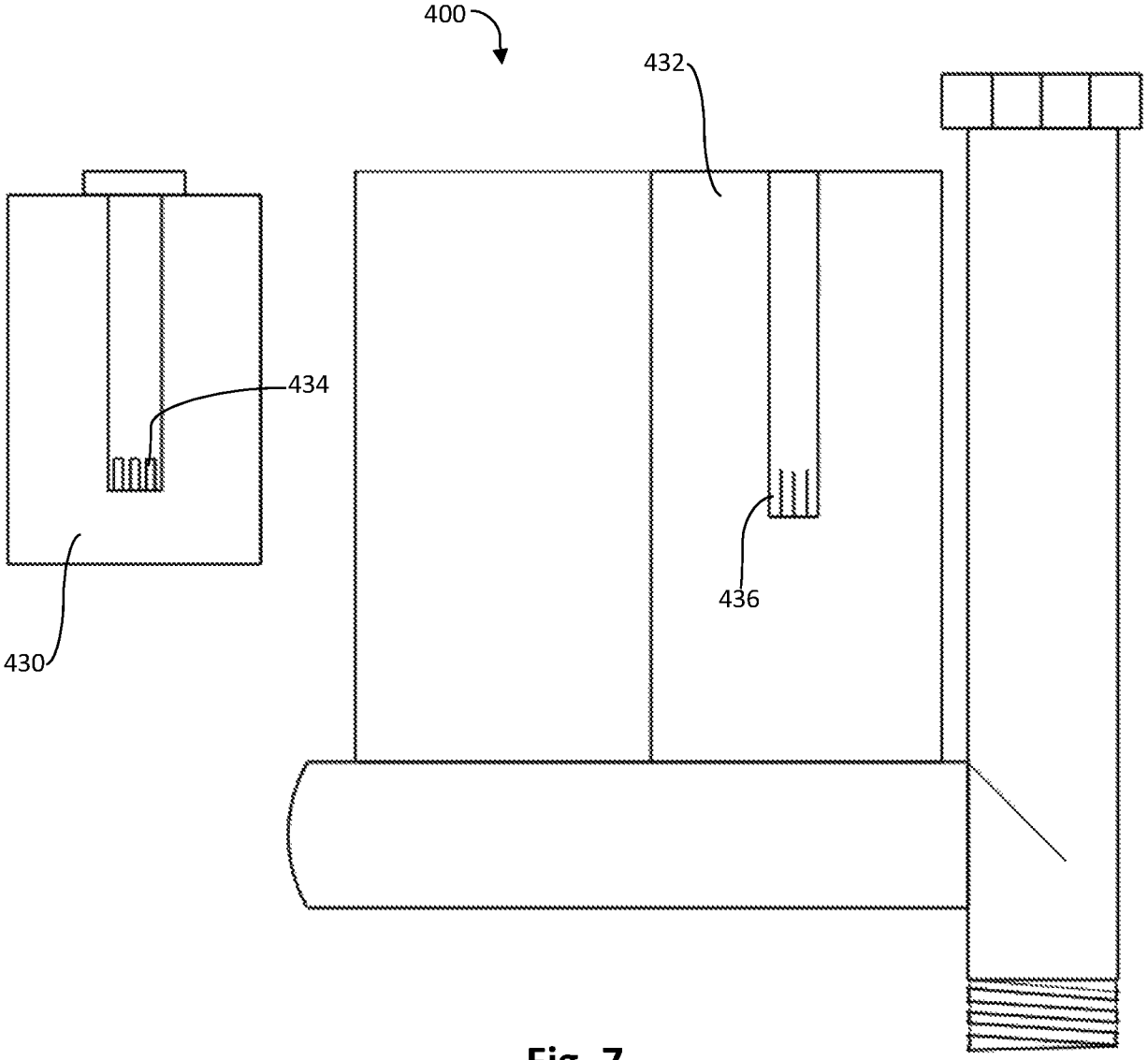
FIG. 7 illustrates a side elevation view of a hose clearing apparatus.

In one embodiment, as shown in FIG. 7, a hose clearing apparatus 400 may further comprise a removable battery housing 430. This allows a user to easily remove the battery housing 430 and accompanying batteries for either replacement or recharge. In one example, a user may remove the battery housing 430 and place on a charger, and may insert a second battery housing 430 into the receptacle 432 of the hose clearing apparatus 400 for use. It will be appreciated that electrical contacts 434 on the battery housing 430 make contact with electrical contacts 436 in the receptacle 432. In another embodiment, other means for charging the batteries may be used, such as a solar panel coupled, and configured, to charge the batteries. In such a manner, the batteries need not be removed and/or replaced as frequently.

Figure 8:
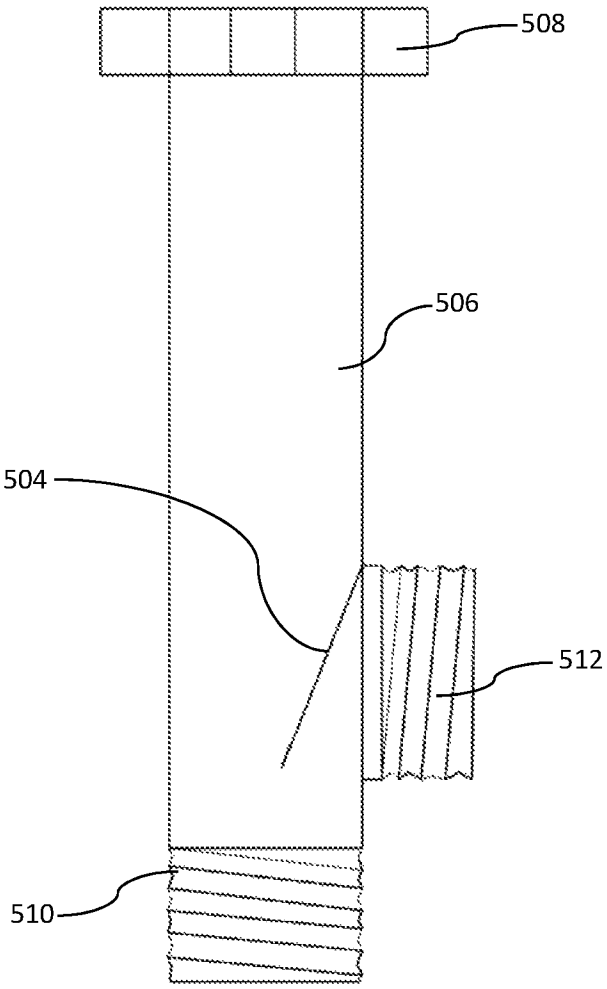
FIG. 8 illustrates a side elevation view of a faucet coupler.
Figure 9:
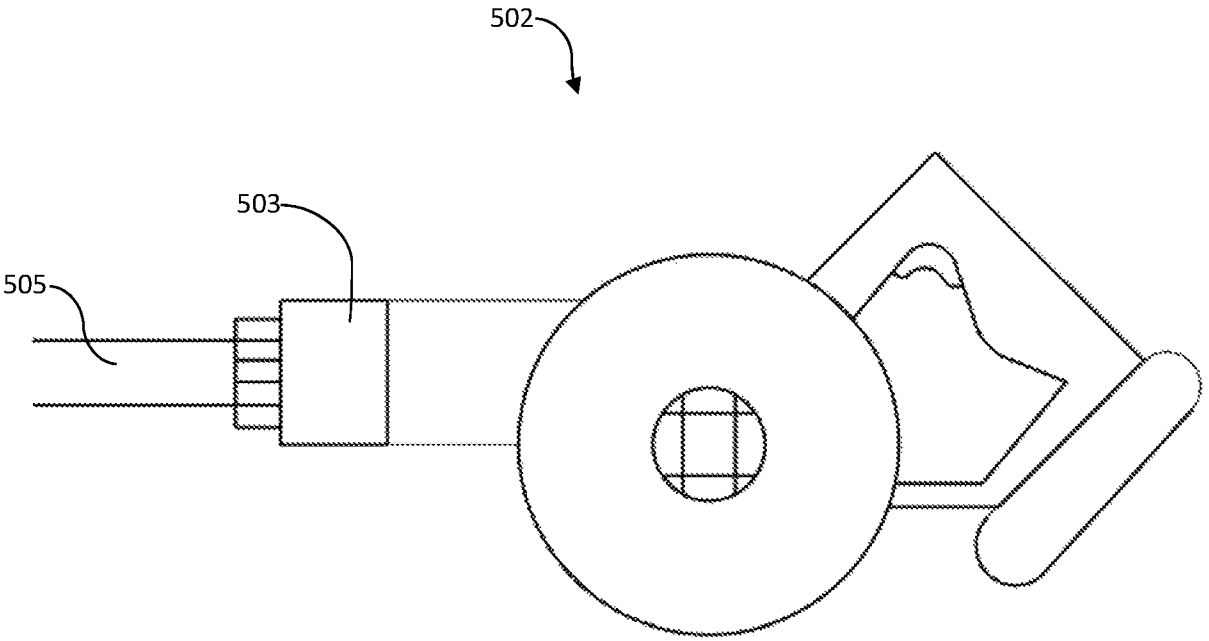
FIG. 9 illustrates a side elevation view of a blower for use with a faucet coupler.

It will be appreciated that the hose clearing devices described above may be manufactured from integral parts (i.e., the faucet coupler and blower are permanently connected as one unit), or be separate individual components, as shown in FIGS. 8 and 9. In one embodiment, as shown in FIG. 8, a faucet coupler 506 comprises a first end 508 for coupling to a faucet, a second end 510 for coupling to a conduit, and a port 512 for coupling to a blowing device (FIG. 9). The port 512 preferably comprises a means for unidirectional flow (e.g., check valve). For example, a port door 504 functions as a check valve, preventing water from entering the port 512. The port door 504 may be hinged and may or may not be spring-loaded. FIG. 9 illustrates a blowing device 502 (e.g., leaf blower or other air-producing device) for use with a faucet conduit 506. A coupler 503 may couple the blower 502 to the faucet coupler 506. It will be appreciated that any number of couplers 503 may be used, each being configured for a specific type, make, or model of blowing device 502. This allows a user to use a variety of components, some of which they may already own (e.g., leaf blower) for the purpose of clearing residue from a hose. The coupler 503 may be coupled directly to the faucet coupler 506, or may use an intermediary coupler 505. Intermediate coupler 505 is useful when space is limited near the faucet and faucet coupler 506.

It is appreciated from the foregoing that the hose clearing apparatus effectively clears liquid from a conduit to prevent freezing. Further, as outlined in one or more embodiments, the use of temperature sensors allows the conduit clearing apparatus to function based upon temperature, providing peace of mind to a user and overcoming problems in the prior art.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A hose clearing apparatus, comprising:

a faucet coupler comprising a first end for coupling to a faucet, a second end for coupling to a conduit, and a port;

a flow switch positioned within the faucet coupler;

an electric blower configured to be coupled to the port of the faucet coupler, the electric blower comprising:

a temperature sensor chip;

a control switch, wherein the control switch is selectively positionable between a manual position and an auto position;

wherein, when the control switch is in the manual position, the electric blower is activated to blow air according to a timer switch that allows a user to control how long the blower is activated;

wherein, when the control switch is in the auto position, the electric blower is automatically activated to blow air when the flow switch senses that a flow of water has ceased and the temperature sensor chip senses that a temperature has fallen to a predetermined threshold;

a check valve configured to allow air from the blower to enter the faucet coupler and to prevent water from the faucet coupler from entering the port and reaching the blower.

2. The hose clearing apparatus of claim 1, wherein the timer switch is configured according to hose length.

3. The hose clearing apparatus of claim 1, wherein the check valve is integral to the faucet coupler.

4. A hose clearing apparatus, comprising:

a faucet coupler comprising a first end for coupling to a faucet, a second end for coupling to a conduit, a port, and a port door; and an electric blower coupled to the port of the faucet coupler, the electric blower comprising a flow switch, a timer switch, and a temperature sensor chip in communication with a control switch;

wherein the control switch is selectively positionable between a first manual position, a second manual position, a first auto position, and a second auto position;

wherein, when the control switch is in the first manual position, the electric blower is activated;

wherein, when the control switch is in the second manual position, the electric blower is activated according to the timer switch based upon hose length;

wherein, when the control switch is in the first automatic position, the electric blower is automatically activated when the flow switch senses that water flow has ceased;

wherein, when the control switch is in the second automatic position, the electric blower is automatically activated when:

a) the flow switch senses that a water flow has ceased, and b) the temperature sensor chip senses that a temperature has fallen to a predetermined threshold;

wherein when the electric blower is activated, air passes through the port and opens the port door, forcing the air out of the faucet coupler and through the conduit.

* * * * *